US010456649B1

(12) United States Patent
Hsiao

(10) Patent No.: US 10,456,649 B1
(45) Date of Patent: Oct. 29, 2019

(54) TARGET TRAINING APPARATUS

(71) Applicant: NINGBO YING KUN SPORTING GOODS CO., LTD., Ningbo (CN)

(72) Inventor: Liang Lang Hsiao, Shetou Township, Changhua County (TW)

(73) Assignee: Ningbo Ying Kun Sporting Goods Co., Ltd., Ningbo, Zhejiang Province (CN)

( * ) Notice: Subject to any disclaimer, the term of this patent is extended or adjusted under 35 U.S.C. 154(b) by 0 days.

(21) Appl. No.: 16/279,061

(22) Filed: Feb. 19, 2019

(51) Int. Cl.
*A63B 69/00* (2006.01)

(52) U.S. Cl.
CPC ..... *A63B 69/0097* (2013.01)

(58) Field of Classification Search
CPC ..... A63B 69/0097
USPC ..... 273/395, 396; 473/434, 435
See application file for complete search history.

(56) References Cited

U.S. PATENT DOCUMENTS 2,264,127 A * 11/1941 Thorstein ..... A63B 63/00 273/381
3,087,701 A * 4/1963 Wallace ..... A47C 20/06 248/166
3,836,144 A * 9/1974 Mahoney ..... A63B 69/0097 248/130
4,650,189 A * 3/1987 Rajacich ..... A63B 69/0097 273/395
5,584,480 A * 12/1996 Grimsrud ..... A63B 71/023 273/396
5,613,922 A * 3/1997 Hsiang ..... A63B 69/0097 108/8
5,807,193 A * 9/1998 Talarico ..... A63B 69/0097 473/421
5,906,552 A * 5/1999 Padilla ..... A63B 69/0097 473/421
5,938,546 A * 8/1999 Caruso ..... A63B 69/0097 473/434
D442,242 S * 5/2001 Rajacich ..... D21/705
7,704,169 B1 * 4/2010 Bove ..... A63B 63/007 473/426
7,959,154 B2 * 6/2011 Ball ..... F41J 1/10 273/407
8,590,901 B2 * 11/2013 Goldwitz ..... A63B 63/00 273/395
10,166,453 B1 * 1/2019 Dickerson ..... A63B 69/0097
2004/0140621 A1 * 7/2004 Liao ..... A63B 69/0097 273/396
2007/0090601 A1 * 4/2007 Liao ..... A63B 69/0002 273/396
2008/0067751 A1 * 3/2008 Hunt ..... A63B 63/00 273/396

(Continued)

*Primary Examiner* — Mark S Graham
(74) *Attorney, Agent, or Firm* — Thomas J. Nikolai; DeWitt LLP

(57) ABSTRACT

A target training apparatus includes an axle shaft, and the axle shaft includes three rebounding portions. Each one of the rebounding portions can be rotated relative to the axle shaft in order adjust angles among each one of the rebounding portions. In addition, each one of the rebounding portions can be positioned onto the axle shaft after the position thereof are set completely. The present invention utilizes three rebounding portions arranged at different angles as different ball striking targets, and the diversity of the ball bouncing direction is increased in order to improve the athlete training effect.

3 Claims, 5 Drawing Sheets

(56) References Cited

U.S. PATENT DOCUMENTS

| | | | | |
|---|---|---|---|---|
| 2013/0072327 | A1* | 3/2013 | Hunt | A63B 63/00 473/434 |
| 2014/0171228 | A1* | 6/2014 | Holland | A63B 69/0097 473/434 |

* cited by examiner

TARGET TRAINING APPARATUS

BACKGROUND OF THE INVENTION

1. Technical Field

The technical field relates to ball sports equipment, in particular, to a target training apparatus.

2. Description of Related Art

FIG. 7 illustrates a prior art of a known target training apparatus, comprising a stand 41 for supporting a bracket 42 on the ground. The bracket 42 includes a net 43 and the net 43 is stretched open thereon in order to allow athletes to strike the net 43 with a ball for bouncing it back to the athletes, and it is used for training purpose.

Although the known target training apparatus allows the adjustment of the stand 41 to change the inclination angle of the net 43, the net 43 has only one surface such that it can only be configured to have a certain angle after adjustment. Consequently, it has the drawback of insufficient use. Furthermore, the bracket 42 is formed into a plane shape as rectangle or circle such that the net 43 is stretched to a flat plane shape. As a result, the rebounding direction of a ball after striking the net 43 is easy to be predicted, causing limited effect in the training of response time of athletes.

BRIEF SUMMARY OF THE INVENTION

A primary objective of the present invention is to provide a target training apparatus, having a plurality of rebounding portions with multiple surfaces arranged at different angles in order to increase different ball striking targets and to increase the variety of the ball bouncing directions, thereby improving the athlete training effect.

To achieve the aforementioned objective, the present invention provides a target training apparatus, comprising:

an axle shaft;

three rebounding portions respectively connected to the axle shaft and capable of rotating relative to the axle shaft in order to adjust an angle among each one of the rebounding portions; each one of the rebounding portions configured to be positioned on the axle shaft after positions thereof are set completely.

According to an embodiment of the present invention, each one of the rebounding portions is formed into a curved shape.

According to an embodiment of the present invention, the axle shaft comprises a shaft member and two assembly disks arranged at two ends of the shaft member; the assembly disk is defined of a central location for connecting to the shaft member; a surrounding of the central location includes three pivotal attachment holes pivotally attached onto the three rebounding portions respectively one by one.

Furthermore, the assembly disk includes a plurality of positioning holes arranged corresponding to any one of the pivotal attachment holes and spaced apart from each other at an equal distance in order to allow each one of the rebounding portions to use an insertion pin for installing into one of the positioning holes for positioning thereof.

According to an embodiment of the present invention, each one of the rebounding portions includes a bracket in a curved shape; the bracket uses a plurality of springs hooked together to form a net in order to allow the net to be stretched into a curved surface.

DETAILED DESCRIPTION OF THE INVENTION

Figure 1:
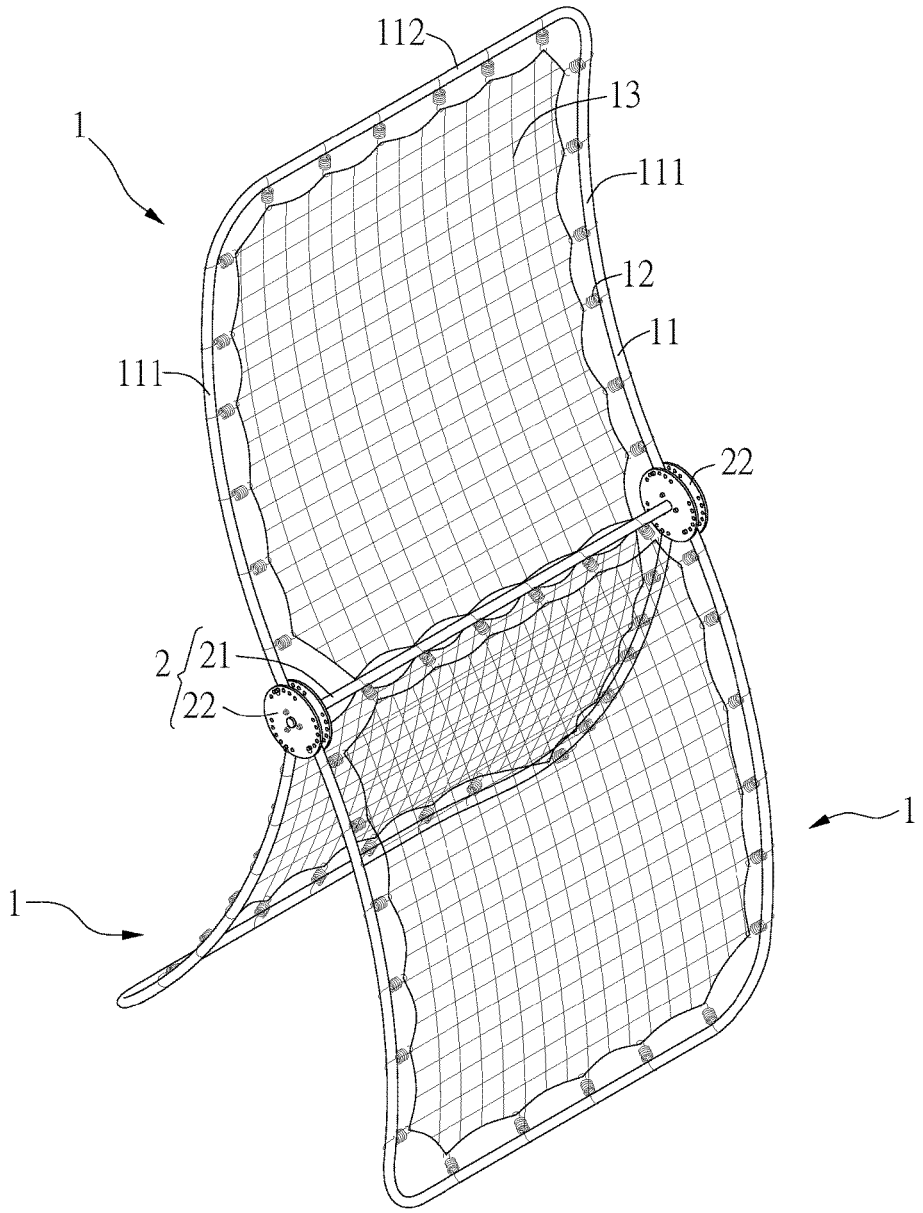
FIG. 1 is a perspective view of the present invention.
Figure 2:
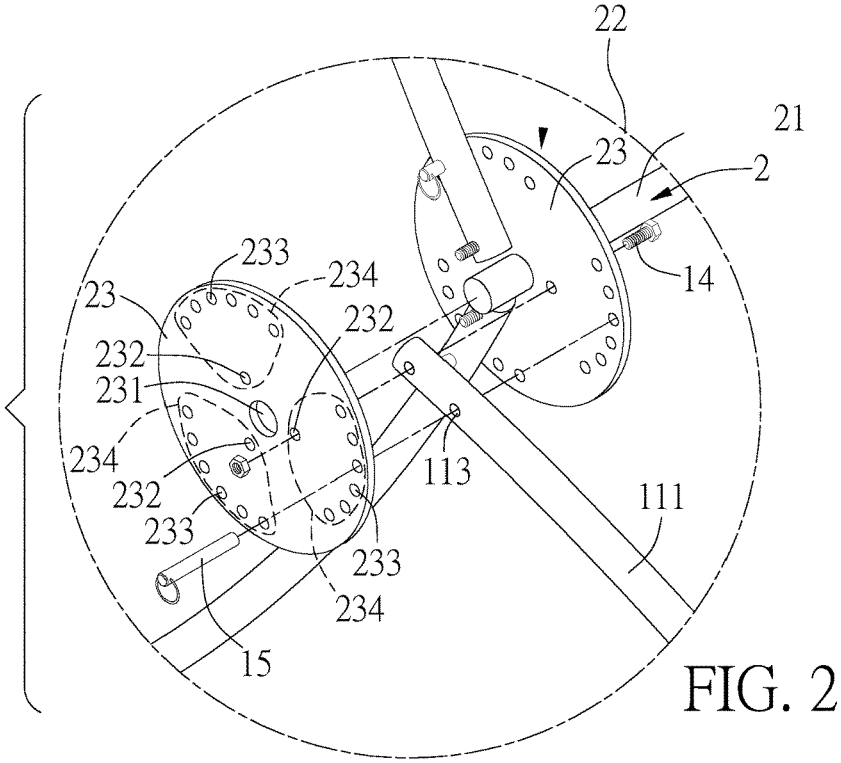
FIG. 2 is a perspective exploded view of the present invention.
Figure 4:
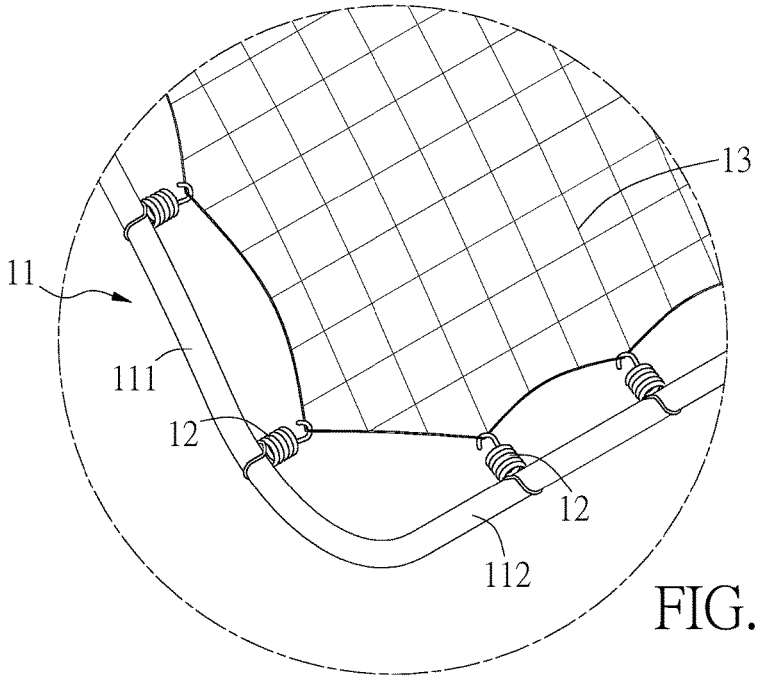
FIG. 4 is a partial view showing a connecting member between the net and the bracket of the present invention.

As shown in FIGS. 1 and 2, according to a target training apparatus of the present invention, the target training apparatus comprises three rebounding portions 1. Each one of the rebounding portions 1 includes a bracket 11, and the bracket 11 utilizes two lateral shafts 111 and a bottom shaft 112 connected to each other in order to formed into a U-shape structure. In addition, as shown in FIG. 4, a plurality of springs 12 are used to hook a net 13 in order to allow the net 13 to form into a stretched shape; wherein the two lateral shafts 111 are formed of curved shapes and are not in the same plane with the bottom shaft 112, such that the net 13 is stretched in a curved surface.

Figure 3:
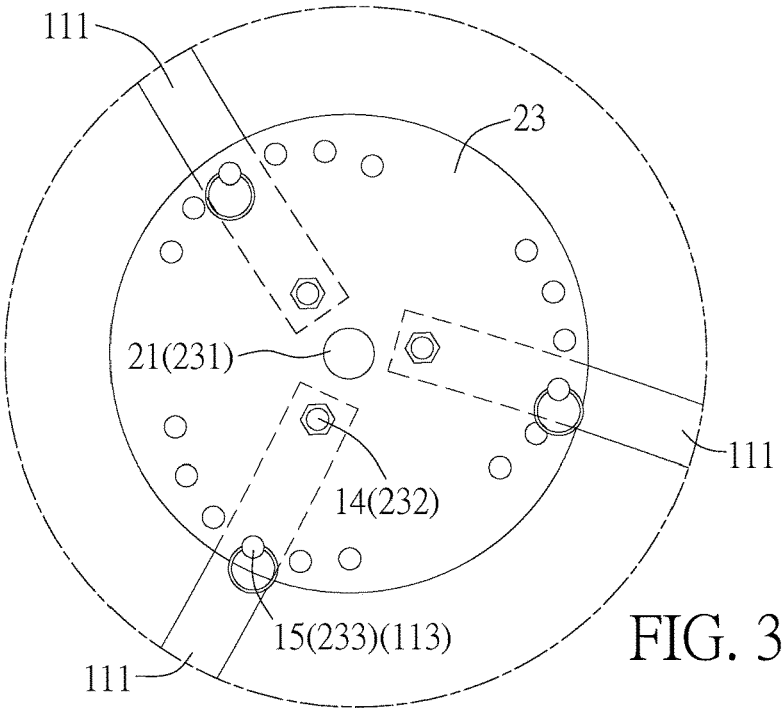
FIG. 3 is partial view showing a configuration of the rebounding portions and axle shaft of the present invention.

The aforementioned three rebounding portions 1 are connected onto an axle shaft 2 respectively in order to allow the three nets 13 to be extended outward from the axle shaft 2. Each rebounding portion 1 can be rotated relative to the axle shaft 2 in order to allow adjust the relative position among each one of the rebounding portions 1, i.e. the angle among the rebounding portions 1, and can be further secured onto the axle shaft 2 after the position adjustment thereof. In this embodiment, the axle shaft 2 comprises a shaft member 21 and two assembly disks 22 arranged at two ends of the shaft member 21. As shown in FIGS. 2 and 3, the assembly disk 22 comprises two disk members 23 arranged parallel and spaced apart from each other. The two disk members 23 are correspondingly defined of a central location 231, three pivotal attachment holes 232 and eighteen positioning holes 233 respectively; wherein the three pivotal attachment holes 232 are circumferentially arranged at a surrounding of the central location 231. In addition, the three pivotal attachment holes 232 and the eighteen positioning holes 233 are divided into three hole groups 234. In other words, each set of the hole groups 234 includes a pivotal attachment hole 232 and six positioning holes 233. The six positioning holes 233 are respectively positioned at an equal distance away from the pivotal attachment hole 232.

The aforementioned assembly disk 22 is connected to the shaft member 21 with the central location 231, and each one of the hole groups 234 is provided to connect to the rebounding portion; wherein the rebounding portion 1 is inserted between the two disk members 23 with its lateral shaft 111, and the lateral shaft 111 is pivotally attached onto the pivotal attachment hole 232 with a pivotal axle 14 in order to allow the rebounding portion to be rotated with the pivotal axle 14 as the center thereof. The lateral shaft 111 further includes an insertion hole 113; wherein a distance from the insertion hole 113 to the pivotal axle 14 is equivalent to a distance from the positioning hole 233 to the pivotal attachment hole 232. Accordingly, the rebounding portion can be configured at a desired position in order to allow the lateral shaft 111 to be pivotally rotated to the corresponding positioning hole 233. At this time, the insertion hole 113 overlaps with the positioning hole 233 such that an insertion pin 15 can be used to insert into the insertion hole 113 and the positioning hole 233 in order to secure the rebounding portion on the assembly disk 22.

Figure 5:
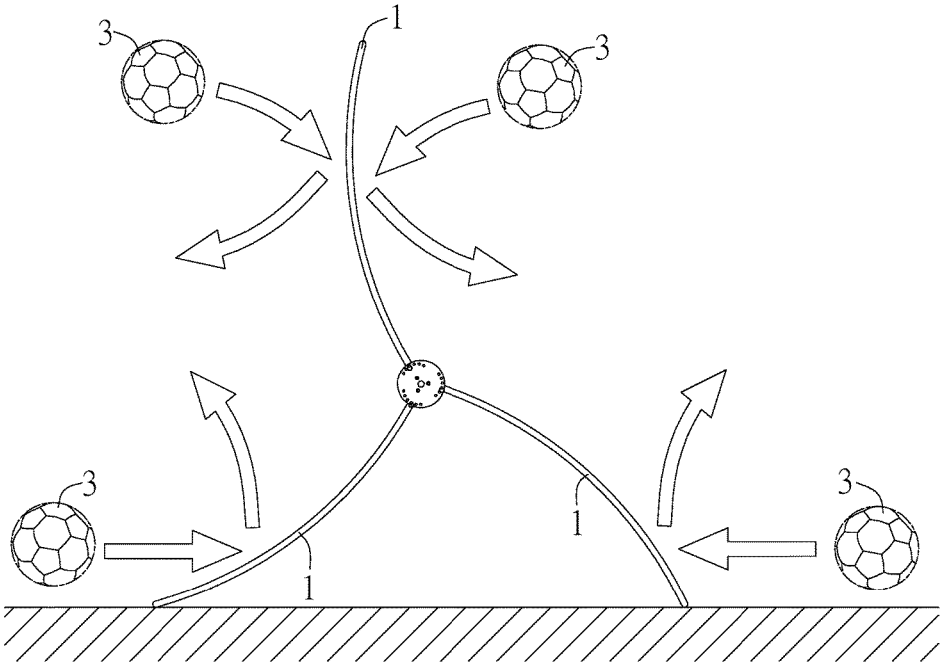
FIG. 5 is an illustration showing a state of use the present invention.
Figure 6:
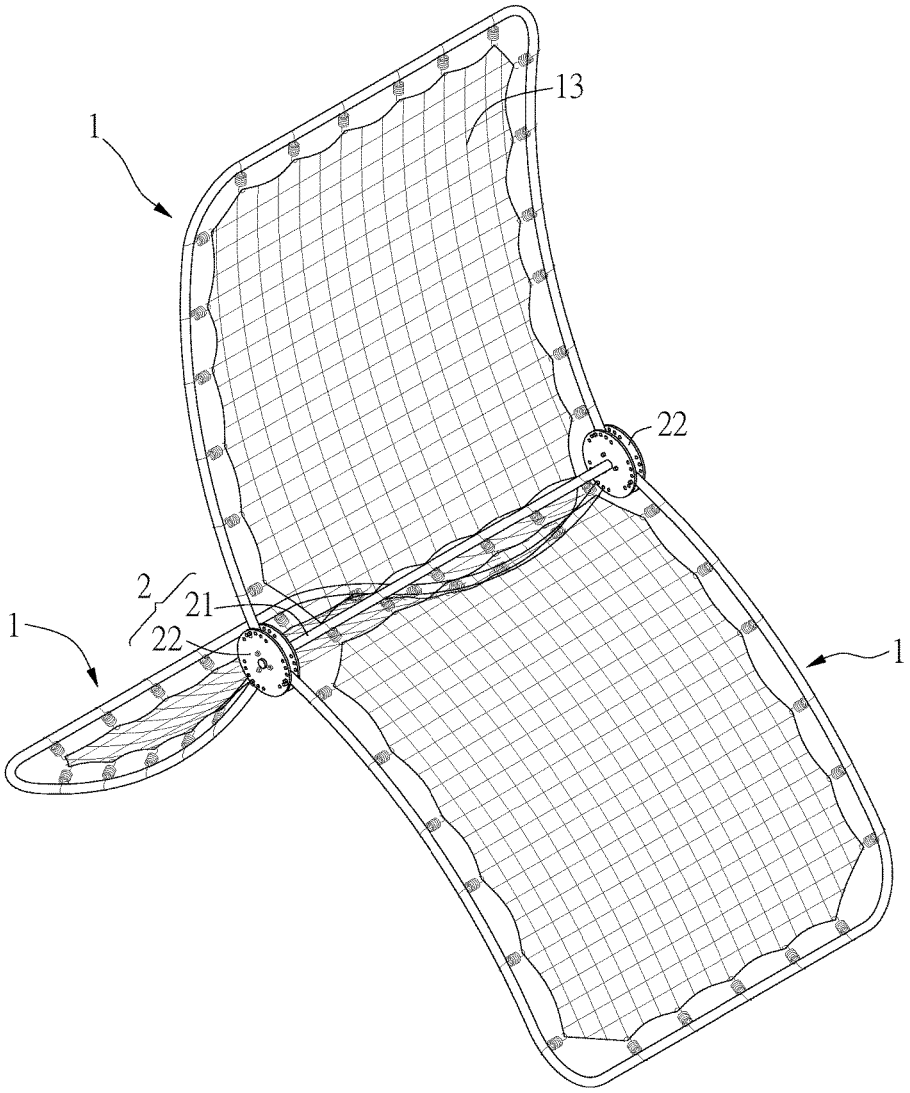
FIG. 6 is a perspective view of the present invention after the positions of the rebounding portions are adjusted.
Figure 7:
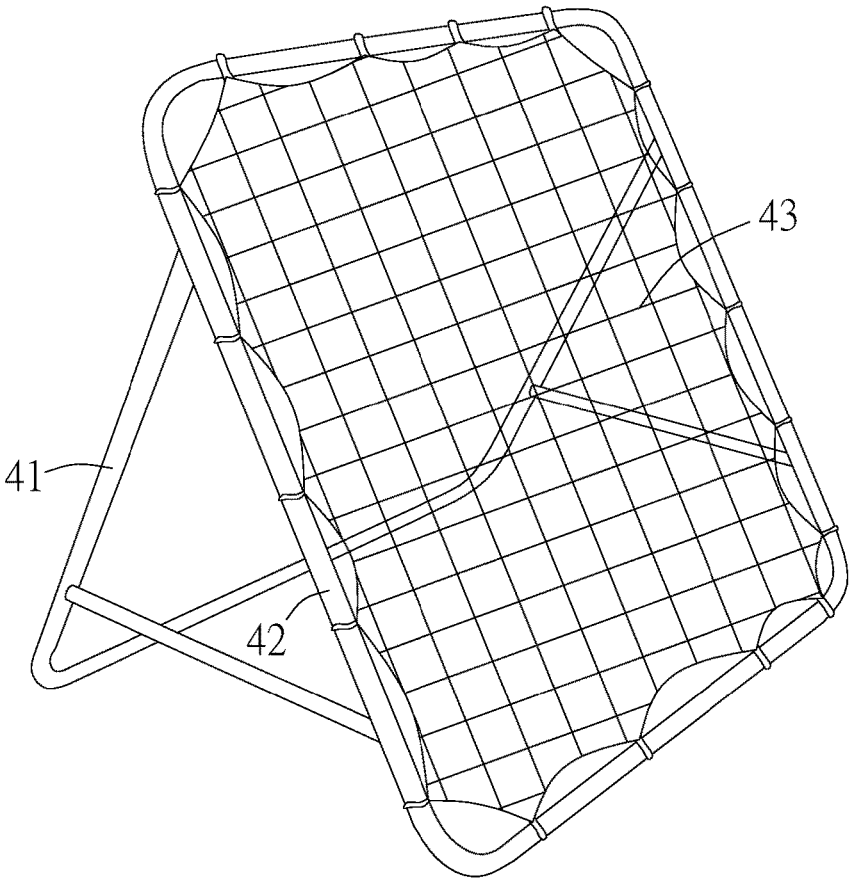
FIG. 7 PRIOR ART
FIG. 7 is a perspective view of a prior art.

As shown in FIG. 5, in the present invention, two rebounding portions 1 can be used as a stand for supporting on the ground, and all of the three rebounding portions 1 can be used as the ball striking targets for athletes. In addition, the nets 13 can be utilized to bounce the ball 3 back. In addition, since the three rebounding portions face different directions, and the nets 13 are stretched in curved surfaces, the rebounding directions of the ball can be of greater diversity. As the rebounding directions are relatively hard to be predicted, the effect of athlete training can be achieved. In addition, the present invention further allows the adjustment of the relative positions of the three rebounding portions 1, i.e. the angles among the three rebounding portions 1. For example, as shown in FIG. 6, the two rebounding portions 1 used as the supporting stands can be opened at a relatively larger angle in order to lower the overall height of the apparatus. Moreover, the orientation of each rebounding portion 1 can be changed at the same time in order to change the rebounding direction to meet the demands for training.

What is claimed is:

1. A target training apparatus, comprising:

an axle shaft comprising a shaft member and two assembly disks arranged at two ends of the shaft member; the assembly disk is defined of a central location for connecting to the shaft member; a surrounding of the central location includes three pivotal attachment holes pivotally attached onto the three rebounding portions respectively one by one;

three rebounding portions respectively connected to the axle shaft and capable of rotating relative to the axle shaft in order to adjust an angle among each one of the rebounding portions;

each one of the rebounding portions configured to be positioned onto the axle shaft after positions thereof are set completely, wherein the assembly disk includes a plurality of positioning holes arranged corresponding to any one of the pivotal attachment holes and spaced apart from each other at an equal distance in order to allow each one of the rebounding portions to use an insertion pin for installing into one of the positioning holes for positioning thereof.

2. The target training apparatus according to claim 1, wherein each one of the rebounding portions is formed into a curved shape.

3. The target training apparatus according to claim 1, wherein each one of the rebounding portions includes a bracket in a curved shape; the bracket uses a plurality of springs to hook a net to be stretched into a curved surface.

* * * * *